United States Patent [19]

Josse et al.

[11] Patent Number: 4,573,541

[45] Date of Patent: Mar. 4, 1986

[54] MULTI-DRAIN DRILLING AND PETROLEUM PRODUCTION START-UP DEVICE

[75] Inventors: Jean-Jacques Josse, Toulouse; Guy Pujols, La Serre de Cazaux; Serge Di Vincenzo, Cassagne, all of France

[73] Assignee: Societe Nationale Elf Aquitaine, Courbevoie, France

[21] Appl. No.: 638,992

[22] Filed: Aug. 9, 1984

[30] Foreign Application Priority Data

Aug. 31, 1983 [FR] France ..... 83 13981

[51] Int. Cl.[4] ..... E21B 7/08; E21B 43/28; E21B 29/06

[52] U.S. Cl. ..... 175/78; 166/117.5; 175/61

[58] Field of Search ..... 166/117.5, 117.6, 52 A; 175/78, 61

[56] References Cited

U.S. PATENT DOCUMENTS

| | | | |
|---|---|---|---|
| 1,900,163 | 3/1933 | Dana | 175/61 |
| 2,492,079 | 12/1949 | Wiley | 166/117.5 |
| 3,330,349 | 7/1967 | Owsley et al. | 166/117.5 X |
| 4,067,385 | 1/1978 | Schwager et al. | 166/6 |
| 4,236,734 | 12/1980 | Ahangarzadeh | 285/26 |
| 4,396,075 | 8/1983 | Wood et al. | 175/79 |
| 4,396,230 | 8/1983 | Wood et al. | 299/4 |
| 4,402,551 | 9/1983 | Wood et al. | 299/5 |
| 4,415,205 | 11/1983 | Rehm et al. | 175/61 |
| 4,444,276 | 4/1984 | Peterson, Jr. | 175/61 |

FOREIGN PATENT DOCUMENTS

| | | | |
|---|---|---|---|
| 670032 | 9/1963 | Canada | 166/52 A |
| 1187727 | 9/1959 | France . | |

*Primary Examiner*—Stuart S. Levy
*Assistant Examiner*—Thomas R. Hannon
*Attorney, Agent, or Firm*—Schwartz, Jeffery, Schwaab, Mack, Blumenthal & Evans

[57] ABSTRACT

Multi-drain drilling and petroleum production start-up device.

This comprises at least one take-off assembly (11) which is fastened in situ in an outer tube of the well and at least one take-off tube (12 to 14) of which communicates by its lower end with a branched well.

The invention is used, in particular, in branched wells.

11 Claims, 7 Drawing Figures

MULTI-DRAIN DRILLING AND PETROLEUM PRODUCTION START-UP DEVICE

The present invention relates to a multi-drain drilling and petroleum production start-up device.

For a very long time, branched drilling wells produced have consisted of a main well and lateral branched wells connected to the main well and forming a certain angle with the latter in order in particular, to increase the production of the "master" or main well.

There are many reasons for drilling a branched well, and these are either economic or linked to the nature of the stratum which is being worked.

In fact, the lateral branches of a master drilling well make it possible not only to increase production, but also to recover the maximum possible content of the deposit worked. Moreover, with one and the same surface installation, these branches make it possible to extend the subterranean zone worked and reduce the high flow resistance which arises near the drill hole in a master well.

Another use of these branches is to make it possible to work strata having a large number of fractures. This is because the lateral branches intercept the fractures and connect them to the drainage system of the master well.

Finally, such branched wells are very useful for the efficient working of a deposit the reservoir of which has a highly irregular roof relief and/or small thickness.

The branches are increasingly produced, starting from the master well, by means of what is called a whipstock. Of course, the diameters of the branches are less than those of the master well, and the deflection angle of each branch is selected as a function of the zone of the deposit into which the branch is to open. In some cases, to minimise the drilling costs, the same whipstock is used to drill two branches symmetrical relative to the master well, by rotating the whipstock 180° in the master well.

After each drilling of a branch, elements necessary for working the deposit are introduced into it. When all the branches are ready to be used, all the devices which are of no use during production are extracted from the master well. This applies, in particular, to the whipstock. It must be pointed out, here and now, that the disadvantage of such a structure of the master well with the branched wells is that it is not possible to benefit from a selective link between the bottom of each branch and the surface.

Reference has been made, in all the foregoing, to lateral branches. Of course, the branches can be oblique, horizontal or in any direction, as long as they are associated with a master well from which they are produced.

As long as the branches are in operation, that is to say are working a deposit, no major difficulty arises.

In contrast, when one or more of the branches has been put out of operation and it is intended to reactivate it or put it into operation again, serious difficulties arise.

The first of these difficulties is connected, above all, with the fact that, during the operating period, the branch has been filled with waste material and it is very difficult to locate it accurately. Admittedly, it would be possible, whenever a whipstock is lowered in order to drill a branch, to note its location in the master well very accurately, so that it can subsequently be returned exactly to the same place. However, such an operation appears difficult to carry out.

The second difficulty is that, even supposing that the original branch can be relocated, it would be essential to use the whipstock again either to free the said reactivated branch from all the material filling it or to start drilling again.

In view of these major difficulties, it may seem preferable not to put the branches into operation again, but to drill new ones, this being very costly even if the drilling of a branch cannot be compared with that of a main vertical well.

The object of the present invention is to overcome the abovementioned disadvantages and propose a device which allows normal working when the branches are in operation, but also, previously, makes it possible to put down a sunk tubing capable of being reconnected at the surface in order, if appropriate, to reactivate one or more of them after they have been put out of operation, without the need for high investment costs.

The subject of the present invention is a drilling and petroleum production start-up device of a drilling well consisting of a master well and at least one branched well opening into the said master well, the said device comprising an outer tube located in the master well and also comprising at least one take-off assembly fastened in situ in the said outer tube and incorporating at least one fixed take-off tube, the lower end of which communicates with a branched well.

The device according to the invention makes it possible to drill as many branches as the take-off assembly possesses take-off tubes. Moreover, the working of the deposit is carried out via the take-off tubes, the deposit fluid discharging directly into the outer tube when the master well has no inner production tubes.

It is also possible, with the aid of accessory means, to make each of the take-off tubes communicate with a production tube or all the said take-off tubes communicate with a single production tube.

According to another characteristic, the device incorporates a connection assembly which, associated with a positioning assembly, makes it possible to drill any branch and put it into operation again after use, this being the result of a fixed key of the positioning assembly, on which bears a cam-shaped profile of the connection assembly.

Other advantages and characteristics will emerge from a reading of the description, given below as an indication but being non-limiting, of a preferred embodiment of the invention and of the attached drawing in which.

Figure 1:
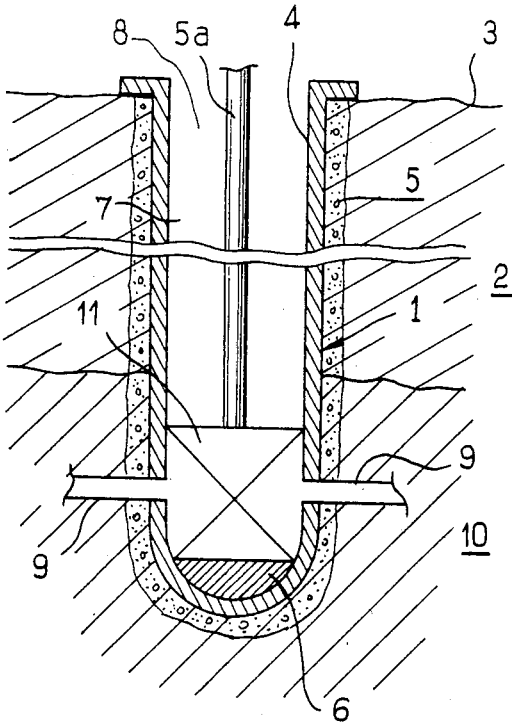
FIG. 1 is a diagrammatic sectional view of a drilling well comprising an outer tube and an inner production tube.

A petroleum-producing well comprises, in a diagrammatic representation, a hole 1 drilled in the subterranean strata 2 from the surface 3 of the ground. An outer tube 4 is lowered within the hole 1, the space between the outer wall of the tube 4 and the inner wall of the hole being filled with cement 5. An inner vertical production tube 5*a*, usually concentric relative to the outer tube 4, delimits with the latter an annular space 7. Finally, a shoe 6 is provided at the lower end of the tube 4. The outer tube 4 constitutes a master well 8 from which branches 9 are drilled, whilst inside the tube 4 there are all the tools necessary for working the deposit 10. All this is well known to specialists and will not be described in detail. Moreover, FIG. 1. is highly diagrammatic and is given merely as an aid to memory.

The device according to the invention, designated as a whole by reference 11, is arranged inside the tube 4.

Figure 2:
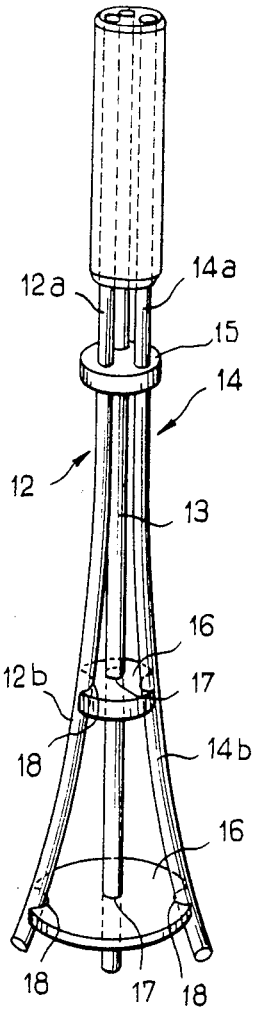
FIG. 2 is a sectional view in perspective of the device according to the invention.

The device essentially comprises (FIG. 2) a take-off assembly comprising at least one take-off tube, preferably three tubes 12, 13, 14 which are arranged at 120° relative to one another and one of which, for example the tube 13, is vertical, whilst the other two 12 and 14 each have a vertical part 12*a*, 14*a* and a curved part 12*b*, 14*b*. The radius of curvature of the curved parts 12*b* and 14*b* depends mainly on the choice of the zones of the deposit to be reached. In the example illustrated in the Figures, the radius of curvature is of the order of 140 m. Consequently, the sections 12*b*, 14*b* of these parts 12*a* and 14*a* with the outer tube 4 which they intersect consist of large ellipses. The height of the deflection assembly is between 4 and 5 m.

The tubes 12 to 14 are connected to one another by means of spacers 15 and 16, the spacer 15 consisting of a disk perforated with three holes at 120°, whilst the spacers 16 are of a different structure to allow the tubes 12 to 14 to be guided and positioned. Each spacer 16 possesses a hole 17 for the passage of the tube 13 and two lateral notches 18 for the tubes 12 and 14. Other structures of the take-off assembly 11 can be envisaged with or without a vertical take-off tube.

The take-off assembly 11 is accommodated in the outer tube 4 and welded to the latter by means of welding spots 20 located at the level of the elliptical lower sections. Cement is injected between the tubes 12 to 14 through an upper orifice 21 made in the outer tube 4, so as to fill the space located between the said tubes and thus produce a rigid compact assembly which is fixed and integral with the said outer tube 4. The excess cement is discharged via an orifice 22 made in the base of the tube 4 below the elliptical sections of the tubes 12 to 14. A shoe assembly 6 is fastened to the tube 4 by means of a weld 23, so that the vertical tube 13 opens into a bore 6*a*.

Figure 3:
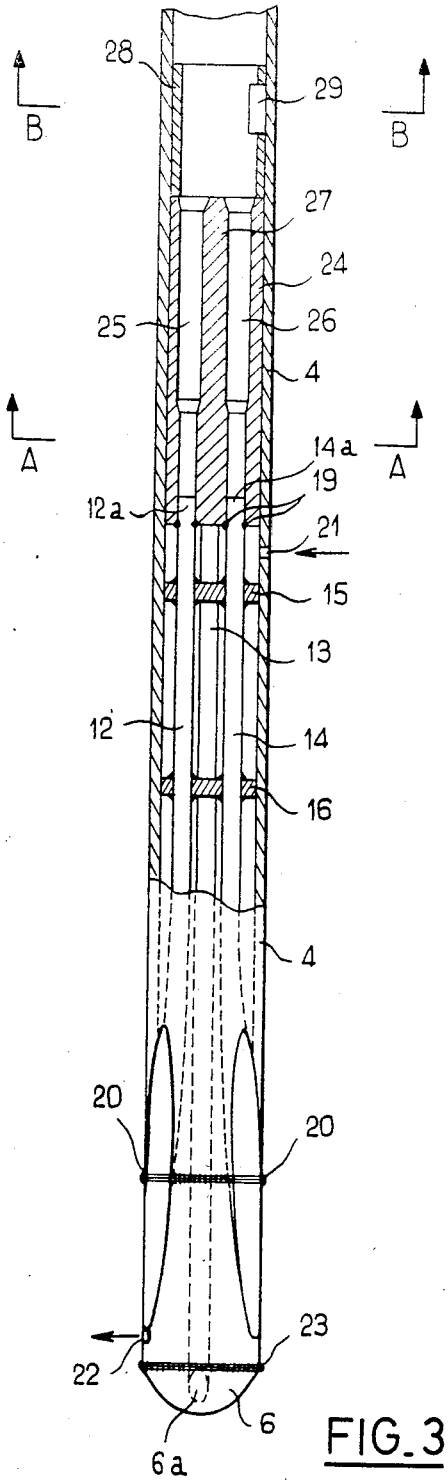
FIG. 3 is a view in vertical section of the device according to an embodiment of the invention.

Located above the take-off assembly and inside the tube 4 is a receptacle 24 which is fastened by means of welding and which possesses as many bores as the take-off assembly 11 possesses tubes. In the example illustrated in FIG. 3, the receptacle 24 has three bores 25, 26, 27 which are arranged at 120° relative to one another and into which open the upper parts or heads of the tubes 12 to 14 respectively, only the heads 12*a* and 14*a* of which can be seen in FIG. 3. The tubes 12 to 14 are welded to the receptacle 24 by means of welding spots 19.

A positioning assembly 28 is likewise fastened inside the tube 4 by means of welding and incorporates a positioning key 29 which is oriented in a suitable way relative to the receptacle 24.

The take-off assembly 11, the receptacle 24 and the positioning assembly 28 remain permanently in the tube 4 for the entire lifetime of the drilling well.

Figure 4:
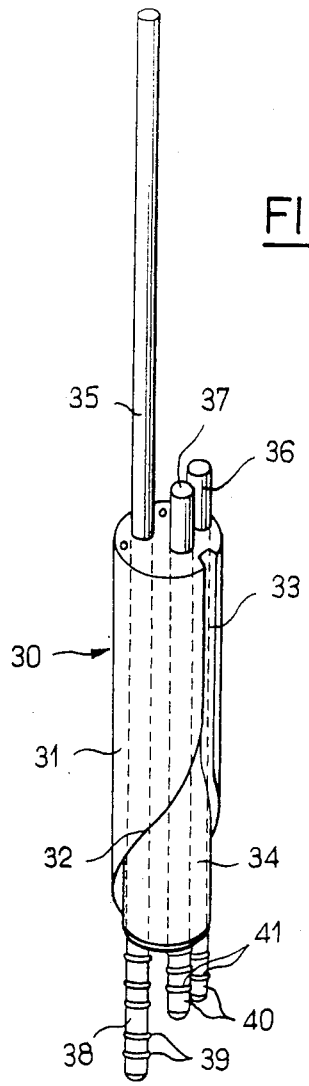
FIG. 4 is a perspective view of a connection assembly according to the invention.
Figure 5:
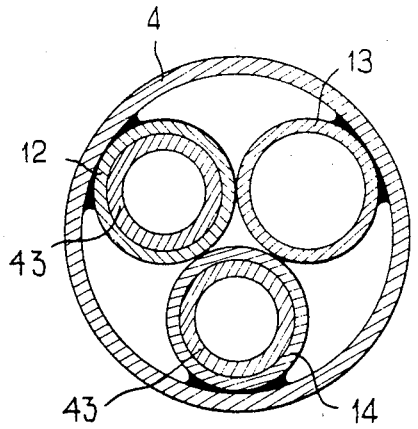
FIG. 5 is a sectional view along the line A—A of FIG. 3.
Figure 6:
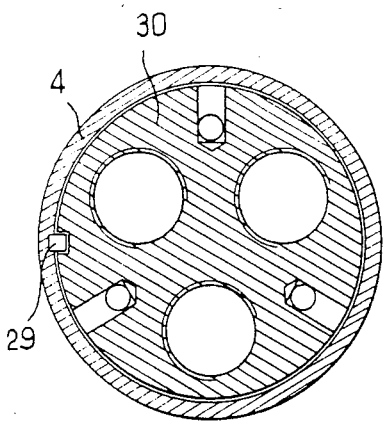
FIG. 6 is a sectional view along the line B—B of FIG. 3.
Figure 7:
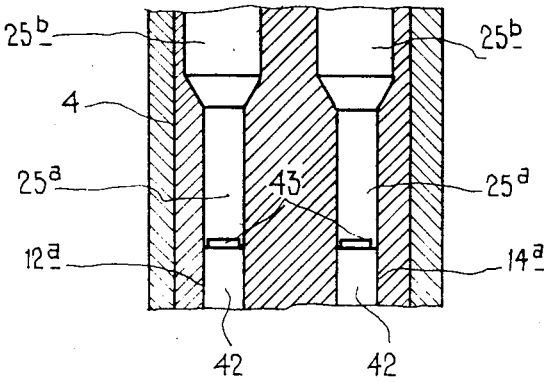
FIG. 7 is a diagrammatic representation of the head of the sunk tubing.

For the drilling, activation and/or reactivation of one or more of the branches 9 of the drilling well which may have been put out of operation, the invention envisages the use of a movable connection assembly 30 illustrated in FIG. 4.

The connection assembly 30 comprises an outer body 31, in which is made a helical ramp 32 on which the key 29 bears during the rotation of the said connection assembly 30, until the said key 29 moves into a guide groove 33 made in the body 31. The connection assembly 30 also possesses an inner part 34, in which bores are made for receiving connection tubes 35, 36, 37. The tube 35 is connected, for example, to the production tube or the riser of the drilling well by means of its upper part and has in its lower part a hollow extension or lengthening piece 38 provided with annular sealing gaskets 39. The lower end of the extension 38 is of conical shape, to allow it to be introduced easily into the corresponding bore in the receptacle 24. The lower ends of the other two tubes 36 and 37 are extended by means of two solid plugs 40 likewise provided with annular sealing gaskets 41, these plugs each having a conical end for easy positioning in the corresponding bores of the receptacle 24. Because of the connection which is made, it goes without saying that the tubes 35 to 37 are likewise arranged at 120° relative to one another.

In the example illustrated, it is the deflection tube 12 which is connected to the production tube or riser of the drilling well, the other two tubes 13 and 14 being blocked by the plugs 40.

When the device described above is installed in the master well 8, two of the take-off tubes are blocked in order to prevent the mud and, above all, the waste materials from rising in the receptacle 24, on the one hand, and ensure complete cementation of the outer tube 4 from its lower end, on the other hand. The positioning of the connection assembly 30 in the blocked take-off tubes does not necessitate annular sealing gaskets 41 in order to allow plugs 40 to be introduced into the receptacle 24. In contrast, when the branches 9 are drilled, the annular gaskets 41 make it possible to isolate them.

A branch 9 is drilled when the position of the lengthening piece 38 and of the tube 35 connected to the surface is selected on the connection assembly 30 and when a train of drill rods (not shown) is introduced into the said tube 35. The train of rods passes through the lengthening piece 38 and the take-off tube corresponding to the branch to be drilled.

After drilling, a sunk tubing or liner 42 is installed permanently, if desired, in each drilled branch. The sunk tubing 42 serves to prevent the walls of the branch from collapsing and is provided with a setting-down and connection head 43 so that, if required, it can be reconnected to the sunk tubing. The head 43 of the sunk tubing is located above the upper ends 12*a* to 14*a* of the take-off tubes and in a lower part 25*a* of the corresponding bore 25 of the receptacle 24. The bore 25 has a part of larger diameter 25*b* for receiving the lengthening piece 38. It shall be noted that the part of smaller diameter 25*a* can also serve for installing a monitoring tool by means of a cable above the head of the sunk tubing.

To complete the master drilling well, the connection assembly 30, the deposit fluid flowing through the take-off tubes which are to be put into operation and the other fixed parts of the device are removed.

To reactivate a branch which may have been put out of operation, the connection assembly 30, suitably equipped for this purpose, is lowered again.

It goes without saying that, in any operation which is to affect one of the branches 9, the connection assembly 30 is lowered in the way described above.

Another advantage of the present invention is that all the upper ends of the take-off tubes are at the same height in the master drilling well, thus allowing great ease of mechanical connection. Futhermore, the deposit fluid can be extracted via one or more of the take-off tubes, with static measurements being carried out at the same time on the other take-off tubes.

Of course, the present invention is not limited to the embodiments described above, but on the contrary embraces all their alternative forms.

We claim:

1. A drilling and petroleum production start-up device of a drilling well comprising a master well and at least one branched well opening into said master well, said device comprising an outer tube having an inner wall, and at least one take-off assembly fastened in situ in said outer tube and incorporating several take-off tubes, at least one of which has a lower end which communicates with a branched well, a space located between said take-off tubes and the inner wall of the outer tube being filled with cement, in order to produce a take-off assembly in the form of a compact and rigid block, said device incorporating a receptacle fastened to the take-off assembly and possessing bores in which upper ends of the take-off tubes are received, a movable connection assembly being interposed between the take-off assembly and surface means necessary for the working of the drilling well, wherein the connection assembly incorporates at least three hollow lengthening pieces having opposing ends, one of said lengthening pieces being capable of being received by one of its ends in one of the take-off tubes, its other end communicating with the surface of the drilling well, and means of blocking the other take-off tube or tubes.

2. A device as claimed in claim 1, wherein the connection assembly incorporates means of guiding a positioning assembly located between the said connection and take-off assemblies, the positioning assembly being arranged above the take-off assembly in such a way that the lengthening piece is introduced into the appropriate take-off tube.

3. A device as claimed in claim 2, wherein the blocking means comprise plugs which extend from a lower end of the connection assembly, said plugs having ends introduced into the tubes to be blocked and possessing sealing means.

4. A device as claimed in claim 2, wherein the take-off assembly comprises two take-off tubes and one vertical tube which are arranged at 120° relative to one another.

5. A device as claimed in claim 2, wherein the positioning assembly comprises a fixed key and passages in which the lengthening piece and the blocking means of the connection assembly are capable of moving, and wherein the guide means comprise a cam-shaped profile which moves on said fixed key during rotation of the connection assembly on the positioning assembly.

6. A device as claimed in claim 5, wherein the take-off assembly comprises two take-off tubes and one vertical tube which are arranged at 120° relative to one another.

7. A device as claimed in claim 5, wherein the blocking means comprise plugs which extend from a lower end of the connection assembly, said plugs having ends introduced into the tubes to be blocked and possessing sealing means.

8. A device as claimed in claim 1, wherein the take-off assembly comprises two take-off tubes and one vertical tube which are arranged at 120° relative to one another.

9. A device as claimed in claim 1, wherein the tubes of the take-off assembly are connected to one another by connecting members, at least one of which is located in a lower part of the said tubes.

10. A device as claimed in claim 1, wherein a sunk tubing is arranged in each branch.

11. A device as claimed in claim 10, wherein each sunk tubing possesses a setting-down and connection head, said head being located above the upper ends of the take-off tubes.

* * * * *